US009070347B2

(12) United States Patent
Bissoli

(10) Patent No.: US 9,070,347 B2
(45) Date of Patent: Jun. 30, 2015

(54) TOOL FOR ROUNDING OFF CORNERS OF FRETS

(76) Inventor: Davide Bissoli, Tokyo (JP)

( * ) Notice: Subject to any disclaimer, the term of this patent is extended or adjusted under 35 U.S.C. 154(b) by 51 days.

(21) Appl. No.: 14/124,423

(22) PCT Filed: Jun. 7, 2012

(86) PCT No.: PCT/JP2012/064644

§ 371 (c)(1),
(2), (4) Date: Mar. 5, 2014

(87) PCT Pub. No.: WO2012/169574

PCT Pub. Date: Dec. 13, 2012

(65) Prior Publication Data

US 2014/0199919 A1 Jul. 17, 2014

(30) Foreign Application Priority Data

Jun. 7, 2011 (JP) ..... 2011-127789

(51) Int. Cl.
*B24D 15/08* (2006.01)
*G10D 3/00* (2006.01)
(Continued)

(52) U.S. Cl.
CPC ..... *G10D 3/00* (2013.01); *G10D 1/005* (2013.01); *G10D 3/06* (2013.01); *B24D 15/02* (2013.01)

(58) Field of Classification Search
CPC ..... B24B 1/00; B24B 37/042; B24B 37/04; B24B 41/06; B24B 49/16; B24D 15/08; B24D 15/081; B24D 15/06; B24D 15/084; B24D 15/063; G10D 1/005; G10D 3/06
USPC ..... 451/28, 555, 557, 558
See application file for complete search history.

(56) References Cited

U.S. PATENT DOCUMENTS 751,165 A * 2/1904 Gessner ..... 451/557
1,520,488 A * 12/1924 Tone ..... 451/540
(Continued)

FOREIGN PATENT DOCUMENTS

JP 2-145965 U 12/1990
JP 52-112312 A 9/1997
(Continued)

OTHER PUBLICATIONS

International Search Report mailed Aug. 14, 2012, issued in corresponding International Application No. PCT/JP2012/064644, filed Mar. 22, 2012, 2 pages.

*Primary Examiner* — George Nguyen
(74) *Attorney, Agent, or Firm* — Christensen O'Connor Johnson Kindness PLLC

(57) ABSTRACT

A file having concave portion is most well-known. The use of this file has a risk of ruining an effect of a leveling of frets due to undesirable scrape of a top portion of the fret and to losing a normal function of the fret due to a change of the height thereof. Since the file is held by hand, a tool angle varies in use. Since the size of a polishing surface of the tool is not suitable for all types of frets, a complete set including a various size of the files is required in order to select and use one of them as necessary and appropriately. Therefore, a tool of the invention has been made to solve these problems as follows: 1. the top portion of the fret is not scraped and the resultant fret after the leveling thereof are protected as important; 2. since the tool is placed on the fretboard with two side portions of the tool, and thus the tool angle is kept constant (thus, during use the axis of the tool is not rotated and the centerline of the tool is not displaced); 3. one model of the tool may be used for all types of frets; and 4. all the frets take a fine symmetrical shape.

10 Claims, 7 Drawing Sheets

(51) Int. Cl.

| | |
|---|---|
| ***G10D 1/00*** | (2006.01) |
| ***G10D 3/06*** | (2006.01) |
| ***B24D 15/02*** | (2006.01) |

(56) References Cited

U.S. PATENT DOCUMENTS

| | | | | | |
|---|---|---|---|---|---|
| 1,585,059 | A | * | 5/1926 | Wanatik | 76/84 |
| 1,994,522 | A | * | 3/1935 | Klingler | 407/29.15 |
| 2,315,749 | A | * | 4/1943 | Tubbs | 451/540 |
| 3,407,466 | A | * | 10/1968 | Granberg | 407/29.15 |
| 3,708,924 | A | * | 1/1973 | Prunchak | 451/558 |
| 3,820,209 | A | * | 6/1974 | Panetta | 407/29.15 |
| 4,037,510 | A | * | 7/1977 | Ginex et al. | 84/453 |
| 4,696,129 | A | * | 9/1987 | Roberts | 451/555 |
| 4,751,795 | A | * | 6/1988 | Jenne | 451/558 |
| 5,097,578 | A | * | 3/1992 | Jandl | 407/29.1 |
| 5,291,805 | A | * | 3/1994 | Byers et al. | 76/88 |
| 5,679,068 | A | * | 10/1997 | Byers et al. | 451/557 |
| D387,262 | S | * | 12/1997 | Byers et al. | D8/91 |
| 7,517,274 | B2 | * | 4/2009 | Santucci | 451/28 |
| 2004/0105959 | A1 | * | 6/2004 | Pearsall et al. | 428/143 |
| 2005/0177963 | A1 | * | 8/2005 | Forcen | 15/104.001 |
| 2005/0221742 | A1 | * | 10/2005 | Su | 451/555 |
| 2008/0271587 | A1 | | 11/2008 | Cross | |
| 2014/0199919 | A1 | * | 7/2014 | Bissoli | 451/28 |

FOREIGN PATENT DOCUMENTS

| | | | | |
|---|---|---|---|---|
| JP | 2002-11670 | A | 1/2002 | |
| WO | WO 8700108 | A1 * | 1/1987 | B24D 15/02 |

* cited by examiner

TOOL FOR ROUNDING OFF CORNERS OF FRETS

TECHNICAL FIELD

The present invention relates to a tool and method for chamfering and rounding off an edge of a fret on a fretboard of a stringed instrument.

BACKGROUND ART

Existing methods, well-known tools, and well-used tool are as follows.

One of them is a file having a concave portion.

When the file is used for chamfering and rounding off an edge of a fret, the top portion of the fret is undesirably scraped, and the height of the fret is unconsciously changed. This ruins a leveling of the frets.

The angle of the file in use is not stable because the angle of the file depends on how the file is grasped with a hand. Therefore, the angle of the polished surface is readily changed, and the resultant final shape is not regular.

The size of the file is not suitable for all kinds of frets, and thus it is required to prepare various sizes of files, which is costly.

One of the other tools is a triangular file.

In order to avoid scratching the fretboard, the triangular file is modified by rounding off edges of a normal triangular file. However, the modified triangular file still has a problem of the angle and the stability, because the file is hand-held even though the file is placed on a portion of the fretboard.

Since the fret is in a long shape and its grip is positioned outer side of the fretboard, it is not easy to hold the file by hand in parallel to the fret. Generally, the triangular file is large and has a rough surface. Therefore, when the triangular file is used, the fret is readily scraped too much, and thus the triangular file is not suitable for precision operation.

SUMMARY OF INVENTION

Problem to be Solved by the Invention

The leveling of the frets is to make the height of the frets uniform to improve a performance of the instrument and produce a clear sound.

When the frets are not in proper conditions, there can occur at least two problems as follows.

1. A terrible sound may be produced because contact between the surface of the fret and the string is unstable and the fret has an unsuitable shape at the contact point with string.
2. The contact point between the fret and the string can move in back and front directions (as in 31 in FIG. 3). This results in a change of the frequency of vibration, which results in shifted tones.

There are various problems for the conventional files.

1. The file having the concave portion is most well-known. The use of this file has risks of ruining an effect of the leveling of the frets due to undesirable scrape of the top portion of the fret and losing a normal function of the fret due to a change of the height of the fret.
2. Since the file is held by hand, a tool angle varies in use.
3. Since the size of the polishing surface of the tool is not suitable for all types of frets, an expensive complete set including a various size of the files is required in order to select and use one of them as necessary and appropriately.

Means of Solving Problems

The present invention provides a tool having a polishing surface facing a fret and whose angle in use is constant with respect to a fret with any shape or height.

This tool provides the best stability and simpleness in use. All what the user should do is to move the tool in back and front directions on the fret to be chamfered to complete the work.

The tool is configured to contact some points on the fret to be chamfered and the fretboard at the same time, and the position and movement of the tool is kept on a centerline during use.

This tool is suitable for the user of various levels from a professional repairman to a general user.

Effect of Invention

The present invention relates to the tool for chamfering and rounding off edges of the fret on the fretboard of the stringed instrument.

Specifically, the tool can be used to repair the shape of an attrited fret or the fret having the top portion planatized by the leveling of the frets, and chamfer roughly and round off the edge of the fret easily.

The present invention has been made to solve he aforementioned problems, and further provides the following advantages;

1. the top portion of the fret is not scraped by the tool, that is, the resultant fret after the leveling thereof are protected as important,
2. since the tool is placed on the fretboard with two side portions of the tool, and thus the tool angle is kept constant (thus, during use, the axis of the tool is not rotated and the centerline of the tool is not displaced),
3. one model of the tool may be used for all types of frets, and
4. since the surface of the fret is polished in the same way consistently, all the frets take a fine symmetrical shape.

DESCRIPTION OF EMBODIMENTS

As follows, examples of the embodiments of the invention are descried with reference to FIGS. 1-15.

The tool of the invention has a flat bottom (FIG. 9) or a curved bottom (FIG. 15), which takes an elongated shape. In an example (FIG. 6-66), the tool with a most common size has a length of from a half to one fret, and a width of from one fret to a width between three frets.

Figure 9:
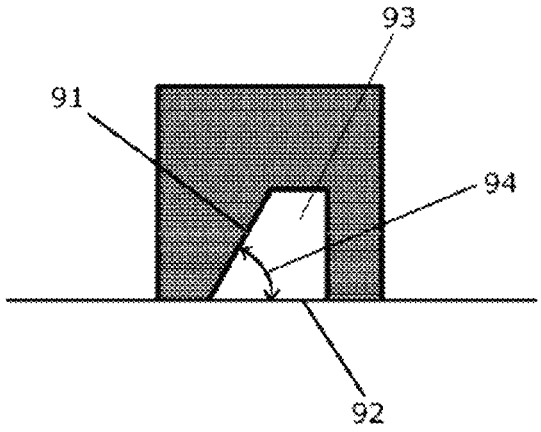
FIG. 9 is a sectional side view of the tool set on the fretboard.

The bottom of the tool has one tunnel-like groove (FIG. 9-93).

The groove of the tool has opposed flat side walls.

Figure 1:
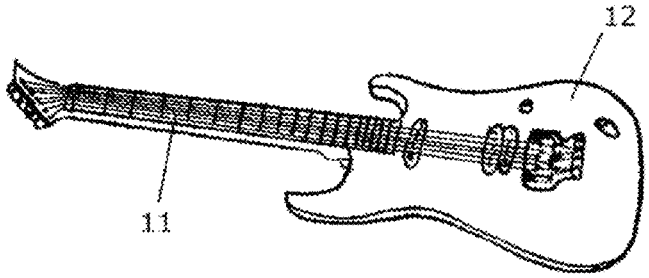
FIG. 1 shows a required part and condition of the instrument for illustrating of the present invention.
Figure 2:
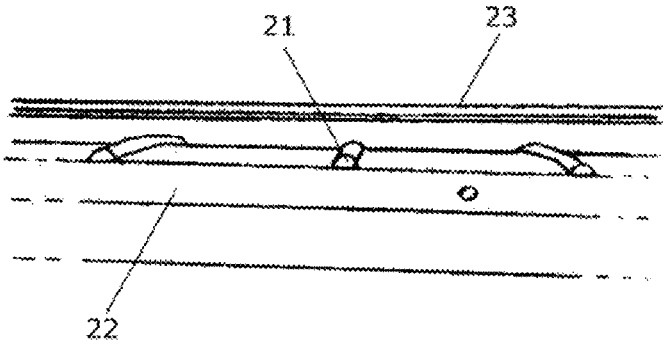
FIG. 2 is a partial enlarged side view of the fretboard.
Figure 3:
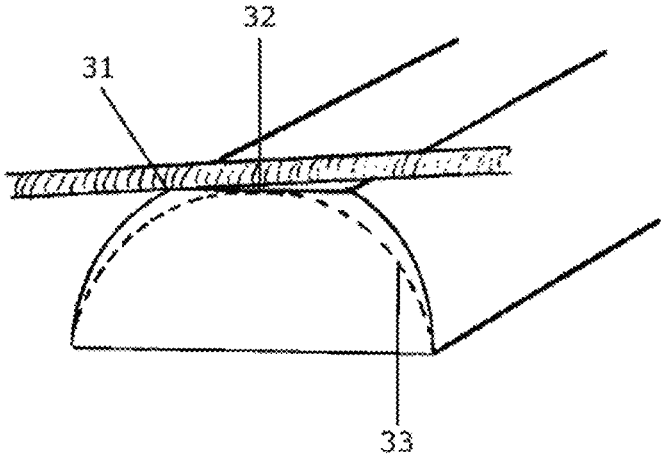
FIG. 3 shows a sectional view of the fret and a side view of he string above the fret during the musical performance.
Figure 4:
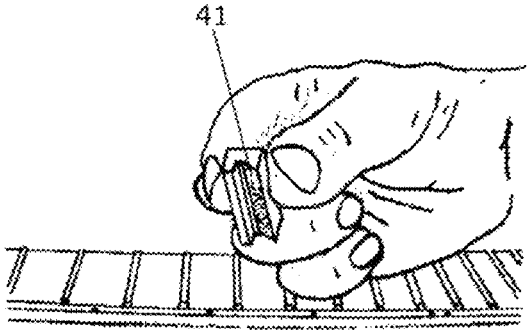
FIG. 4 is a figure of a file portion of the tool related to the invention shown by grasping the tool by hand.
Figure 5:
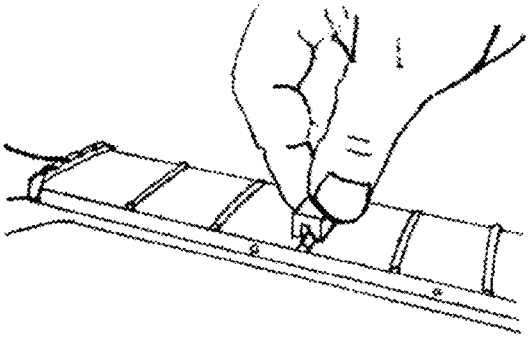
FIG. 5 shows a site and example of the use of the invention.
Figure 6:
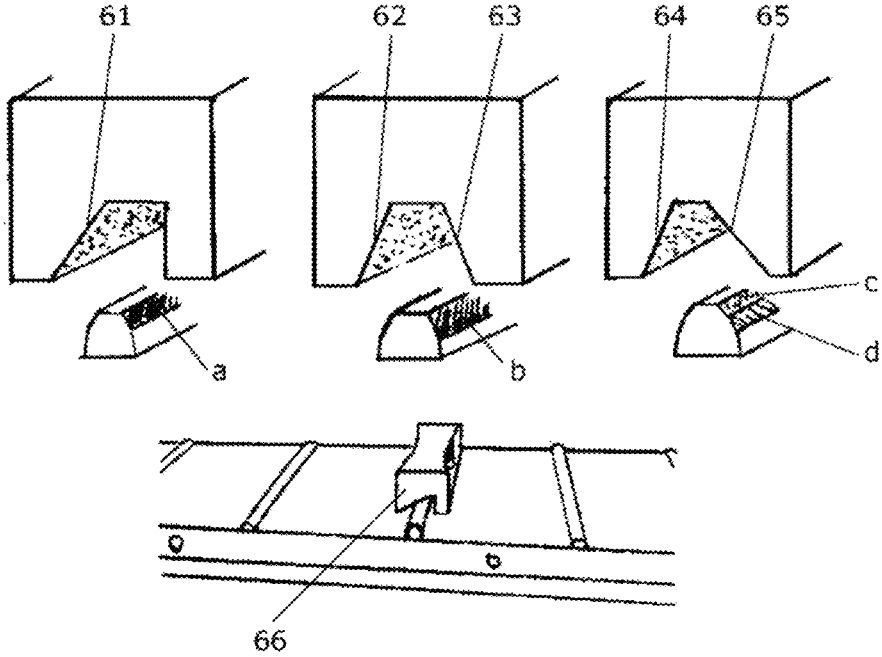
FIG. 6 is perspective views of the tool related to the invention illustrating the different polishing surfaces and the effect thereof to each fret.

At least one wall of the groove has a polishing member and tapers toward the center of the tool as shown in FIG. 6-61.

When two walls have the polishing members, the walls may taper toward the center of the tool at the same angle (FIG. 6-62 and FIG. 6-63) or at different angles (FIG. 6-64 and FIG. 6-65), and may have the same polishing member or different kinds (particle sizes) of the polishing member.

As follows, the polishing member may;

have an adhesive surface (e.g., polishing material adhered on a platform material or a mount paper), be fixed, be soldered, be fixed with a screw, be chemically fixed, or be coated.

As follows, the kind of polishing materials may;

be a diamond powder, be the file, be a sandpaper and the like.

Figure 8:
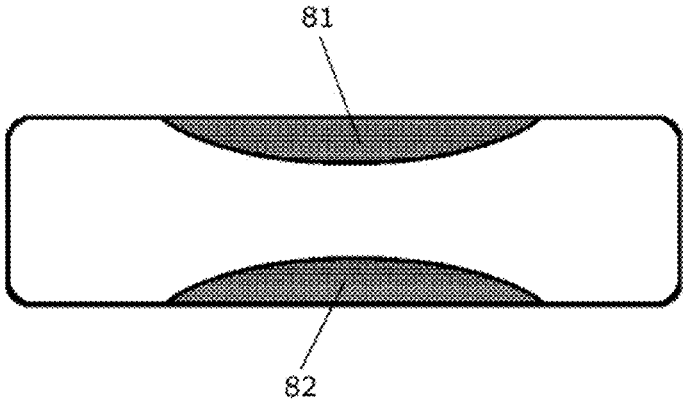
FIG. 8 is a top view showing two recessed portions located in the sides of the tool for easy gripping.

The tool has the recessed portions on outer side surfaces for easy gripping as shown in FIG. 8-81 and FIG. 8-82. The recessed portions ma be portions for engaging a main body with fingers or a hand. The recessed portions may be replaced with a handle.

When the tapered file surface of the groove (FIG. 9-91) is pushed to the side of the fret, there always exists a gap between an upper part of the groove (FIG. 9-93) and the top portion of the fret.

When the tapered file surface of the groove is pushed to one of the side surfaces of the fret, the opposed surface of the groove is not in contact with an opposite side surface of the fret.

Figure 10:
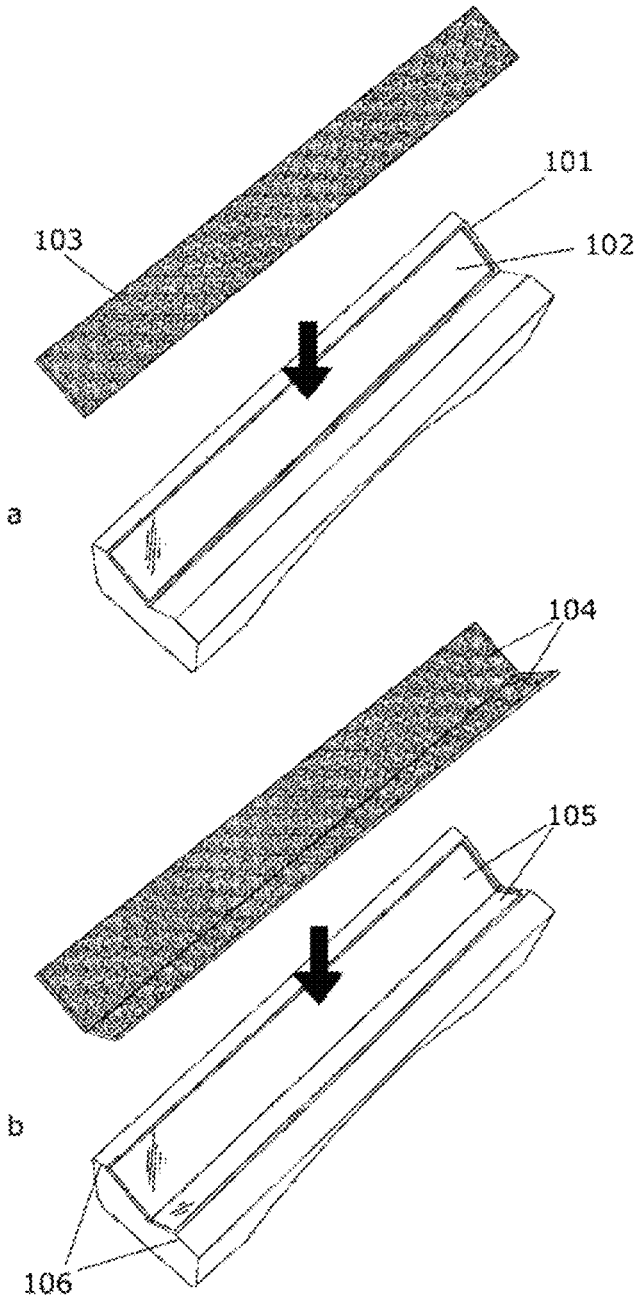
FIG. 10 is bottom perspective views of two examples of the tool.

FIG. 10-*a* and FIG. 10-*b* are bottom perspective views of two examples of the tool.

FIG. 10-*a* shows one characteristic example of the tool. This tool has a frame to hold, with adhesion or engagement, a polishing member having a base (FIG. 10-103) so as to receive and keep the polishing member in a specific part (FIG. 10-102) of the frame so that the polishing member having the base cannot be moved, come of or removed during use.

As the other example. FIG. 10-*b* shows the groove of the tool having a specific part formed on the two walls of the groove. The specific part houses a bent polishing member having two file surfaces (FIG. 10-104) by engagement, or two polishing members having bases on each installation site.

Two above-mentioned examples of the tool are suitable for reuse of the tool. Thus, the user can replace the polishing member having the base when the polishing member becomes fully worn or when the user wants to use a polishing member with a different particle size Examples of a fixing means for fixing the polishing member having the base to the tool include a protruding part, step and frame. However, when the polishing member is fixed by adhesion, soldering or chemical action, it is not necessary to use such means, that is, such means is not necessary.

The following describes the example where the file surface is not flat but curved.

Figure 11:
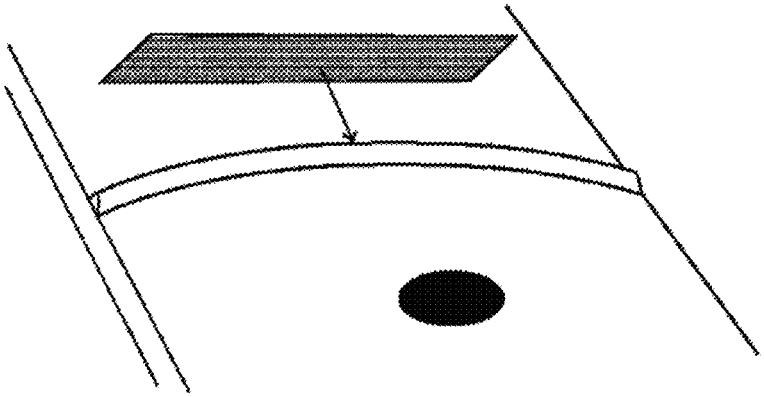
FIG. 11 is a perspective view for illustrating the contact point of the file with the fret when the file surface is flat.

In the above example, the file surface is flat. When the flat file surface contacts in parallel with a fret on a curved fretboard of an instrument, a contact area between the file surface and the fret is small as shown in FIG. 11. Although the flat file surface is sufficiently functional, the file surface may be curved to improve efficiency.

In this case, the file surface is a curved surface configured to curve outward (in the direction of the opposite side of a contacting surface with the fret) from both ends to the center of the file surface in the longitudinal direction so that the file surface conforms to the curved fret.

The curved file surface increases the contact area between the file surface and the fret, which leads to the increased working efficiency.

Figure 13:
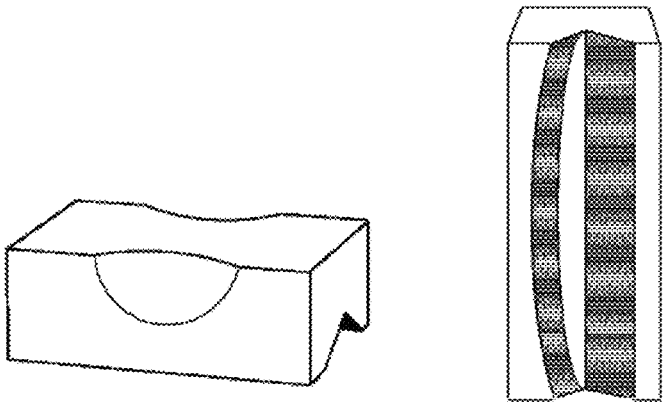
FIG. 13 is perspective and bottom views of an example of the tool having flat and curved file surfaces.

FIG. 13 shows the example of the tool having the curved surface as mentioned above and flat surface. The tool related to this example is adapted for various instruments and is further useful to the instrument having a curved fretboard such as an electric guitar as well as the instrument having a flat fretboard such as a classic guitar.

Figure 12:
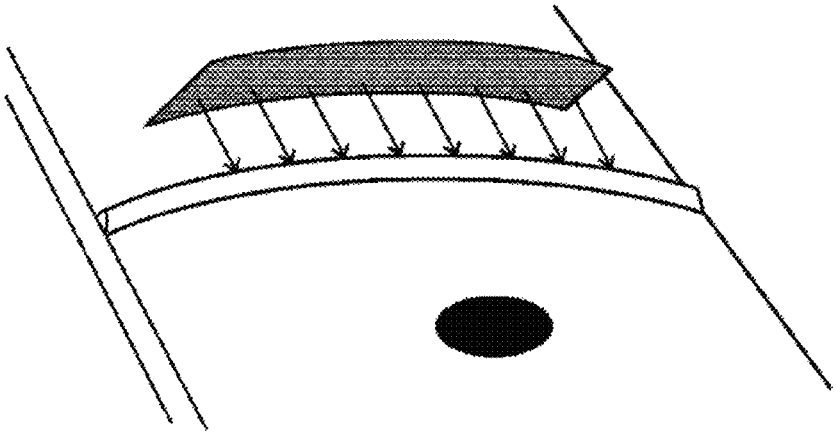
FIG. 12 is a perspective view for illustrating the contact point of the file with the fret when the file surface is curved.
Figure 14:
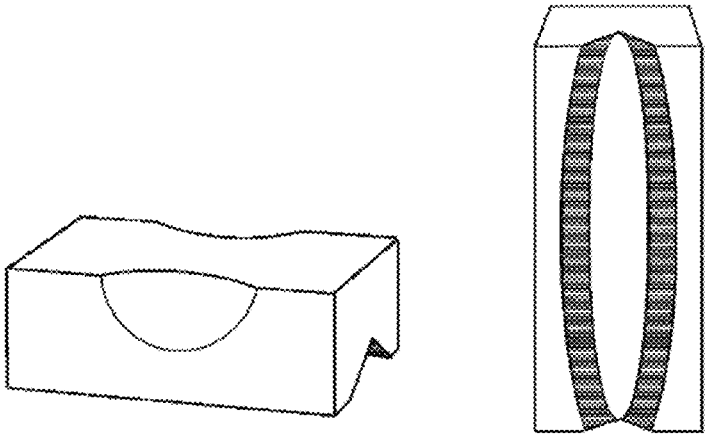
FIG. 14 is perspective and bottom views of an example of the tool having curved file surfaces.

FIG. 14 shows the example of the tool having curved file surfaces as shown in FIG. 12. When the tool has opposed tapered file surfaces, these tapered file surfaces may have the same inclined angle or different inclined angles, and the same polishing member or different kinds (particle sizes) of polishing member. The tool may have the file on one of tapered surfaces.

The following describes the example where tool surfaces in contact with the fretboard are not flat but curved.

There are flat fretboards as well as curved fretboards in the width direction. Generally, the fretboards of the electric guitar the electric bass and the like curve in the width direction thereof. The tool surfaces in contact with the fretboard may be curved to improve the slidability of the tool.

In this case, bottom surfaces of the tool in contact with the fretboard (FIG. 15-151) curve upward from both ends to the center in the longitudinal direction of the bottom surfaces (in use of the fret).

Figure 15:
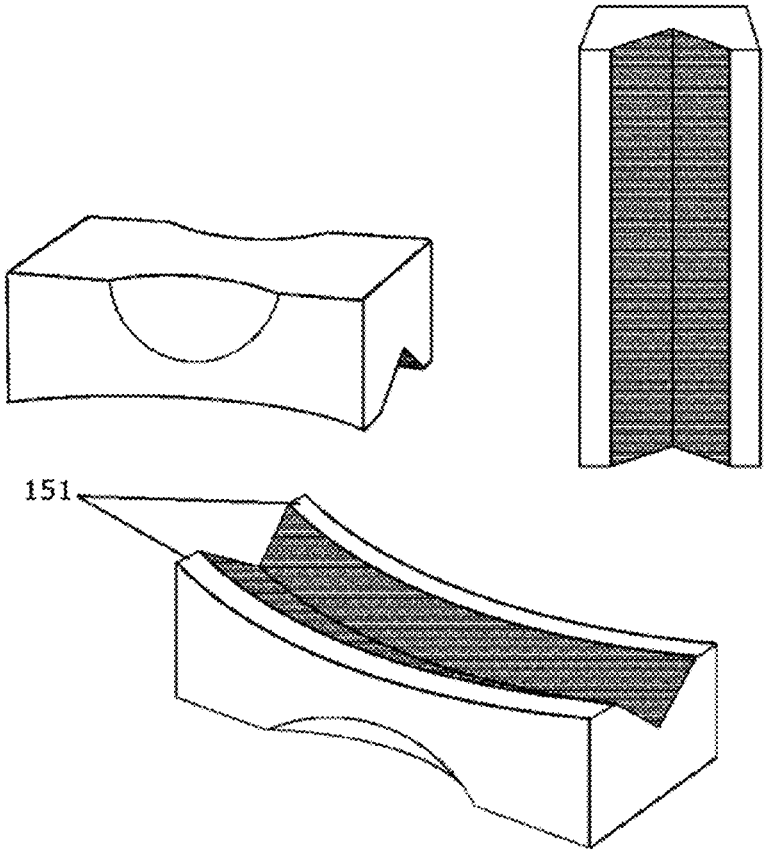
FIG. 15 is top perspective, bottom perspective and bottom views of an example where the tool has the curved surface to be contacted with the fretboard.

FIG. 15 shows the example of the tool having such curved bottoms.

An example of how to use is described in the following.

Strings of the instrument are removed or fully loosened and then moved to the end of the instrument so that the tool of the invention or other tools can be used on the fretboard to complete the work and finishing work to the fret.

The fretboard is covered with a paper tape or materials for protection similar to the paper tape (FIG. 7-73) so as to expose the frets.

The tool is placed on the fretboard so that the polishing surface of the tool (FIG. 7-71) contacts in parallel with a target fret to be polished.

If possible, the recessed portions on the sides of the tool (FIG. 8-81 and FIG. 8-82) are held with two fingers.

The tool is slid along the side of the fret so as to chamfer the edge generated on the fret due to the planarization of the top portion of the fret.

Shavings generated by the polishing are removed before these shavings are accumulated in the shavings excessive amounts or interrupt the polishing.

Figure 7:
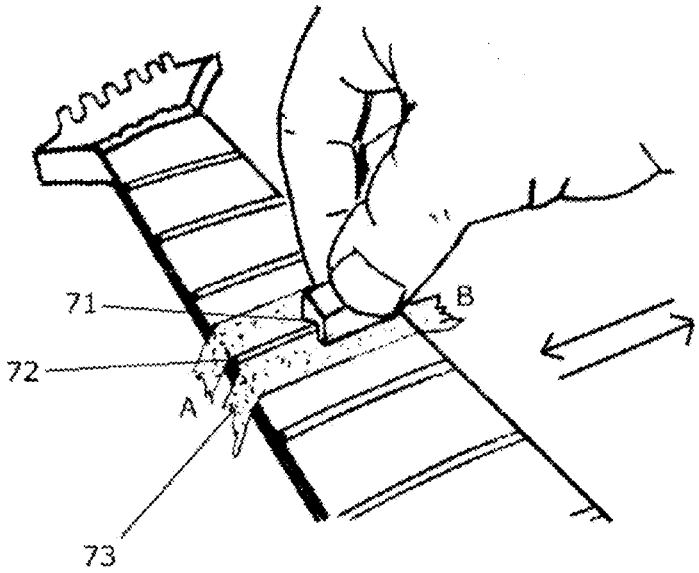
FIG. 7 is an in-use view of the tool used on the fretboard with it caught.

The tool is pushed so that a selected file surface (FIG. 7-71) contact the fret, and then the tool is moved in back and forth direction between A and B in parallel with the longitudinal direction of the fret indicated by the arrows shown in FIG. 7, until the edge is scraped and polished.

The opposite edge of the fret is scraped and polished in the same way, and the resultant fret takes the symmetric and curved sectional shape. Therefore, string of the instrument contacts with the top portion of the fret as shown in FIG. 3-32.

Approximately one millimeter width of the flat surface, in parallel with the surface of the fretboard, of the top portion of the fret remains the same.

FIG. 6 shows notable examples of the polished (processed) frets by the tool.

The edge of the fret can be further rounded off by the polishing using tools having polishing surfaces with different inclined angles.

The small remaining edge is carefully polished using sandpaper attached to or held on the finger and then using a polishing fiber for metal so as to avoid scraping the fret too much and keep the height of the fret unchanged. After the polishing, the fret should take the shape shown in FIG. 3-33.

The fret is polished until it has a glossy appearance, if necessary.

After the polishing, the protection materials such as the paper tape on the fretboard are removed.

After such protection materials are removed, the fretboard is cleaned.

Finally, the strings of the instruments are tuned so as to be suitable for the fretboard having repaired frets and then the instrument is adjusted.

Explanation of Symbols

FIG. 1-11 Fretboard mounting frets

FIG. 1-12 Guitar

FIG. 2-21 Fret

FIG. 2-22 Fretboard

FIG. 2-23 String producing a sound while contacting with the fret

FIG. 3-31 Example of an improper contact of the string with the fret when fret shape is improper FIG. 3-32 Correct contact formed by using this invention FIG. 3-33 Shape required to exert the function of the fret FIG. 6-61 Figure shows the polishing surface capable of producing the symmetric shape by rotating the tool at 180 degrees with respect to the fret on the surface of the fretboard and then polishing the edge of the edge at the opposite side of the polished edge of the fret FIG. 6-62, FIG. 6-63 Each figure shows polishing surfaces, respectively. The tool having two symmetric polishing surfaces can produce the symmetric shape of the fret.

FIG. 6-64, FIG. 6-65 Each figure shows polishing surfaces of the tool, respectively. These polishing surfaces have different (or asymmetric) angles so as to carry out a first step of chamfering one of edges of the fret. Such polishing surfaces are used alternately.

FIG. **6-*c*, FIG. 6-*d* Each figure shows the results of the combination of surfaces of FIG. 6-64 and FIG. 6-65, respectively. These results indicate that the edge can be chamfered properly and quickly FIG. 6-66 Exemplary side surface of the tool FIG. 7-71** Figure showing the condition where one of the polishing surfaces of the tool contacts with the fret.

FIG. 7-72 Fret being scraped by the tool of the invention

FIG. 7-73 Protection member (paper tape and other materials) set on the fretboard to protect the fretboard from the tool, shavings generated by the polishing, or any materials capable of damaging the fretboard FIG. 8-81, FIG. 8-82 Recessed portion for holding the tool easily FIG. 9-91 Polishing surface FIG. 9-92 Fretboard FIG. 9-93 Tunnel-shaped groove to house the fret FIG. 9-94 Figure showing an example of the inclined angle between the fretboard and polishing surface which remains unchanged due to the structure of the tool even though the tool is set anywhere FIG. 10-101, FIG. 10-102 Frame for adhesion or engagement of exchangeable abrasives FIG. 10-103 Exchangeable polishing member having the base FIG. 10-104 Exchangeable polishing member having the base FIG. 10-105 Frames for adhesion or fitting of exchangeable polishing member FIG. 10-106 Bottom surfaces of the tool in contact with the fretboard FIG. 15-151 Bottom surfaces of the tool in contact with the fretboard

The invention claimed is:

1. A tool for chamfering and rounding off an edge of a fret on a fretboard of a stringed instrument having the fret, comprising:

a main body comprising:

a portion for engaging with a finger or a hand, side portions having bottom surfaces configured to slide on the fretboard with the side portions sandwiching the fret therebetween, and a groove formed between the bottom surfaces of the side portions, wherein:

the groove has a tapered file surface and a surface opposed to the tapered file surface, and the groove is configured in such a way that, when the tapered file surface is pushed to one of the side surfaces of the fret, the opposed surface is not in contact with the other of the side surfaces of the fret.

2. The tool of claim 1, wherein the groove has opposed tapered file surfaces and is configured in such a way that, when one of the tapered file surfaces is pushed to one of the side surfaces of the fret, the other of the opposed surfaces is not in contact with the other of the side surfaces of the fret.

3. The tool of claim 1, wherein the groove has opposed tapered file surfaces and these tapered file surfaces have the same inclined angle.

4. The tool of claim 1, wherein the groove has opposed tapered file surfaces and these tapered file surfaces have different inclined angles.

5. The tool of claim 1, wherein the groove has opposed tapered file surfaces, and these tapered file surfaces have the same particle size.

6. The tool of claim 1, wherein the groove has opposed tapered file surfaces and these tapered file surfaces have different particle sizes.

7. The tool of claim 1, wherein the tapered file surface of the groove is a curved surface configured to curve outward in a width direction of the main body, from both ends to the center of the tapered file surface in the longitudinal direction.

8. The tool of claim 7, wherein the groove has opposed tapered file surfaces, one of the tapered file surfaces is flat, and the other of the tapered file surfaces is the curved surface.

9. The tool of claim 1, wherein the bottom surfaces in contact with the fretboard area curve upward from both ends to the center in the longitudinal direction of the bottom surfaces.

10. A method for operating a finishing work to chamfer the edge of the fret using the tool according to claim 1, comprising:

loosening the strings, the strings being moved away from the fretboard;

covering only the fretboard with a paper tape or other film materials for protection;

setting the tool on the fretboard so that the file surface of the tool contacts with a fret surface to be polished; and moving the tool along the fret in such a way that both edges of the fret are finished.

* * * * *